United States Patent [19]

Iwabuchi et al.

[11] Patent Number: 4,845,327

[45] Date of Patent: Jul. 4, 1989

[54] MICROWAVE OVEN HAVING AUTOMATIC BREAD MAKING FUNCTION

[75] Inventors: Koji Iwabuchi; Masaharu Tawada; Noriyuki Kanagawa; Mituhiro Aoyama; Katsuhiro Yamazaki, all of Chiba; Kazuo Kaneko, Kanagawa, all of Japan

[73] Assignee: Hitachi Heating Appliances Co., Ltd., Chiba, Japan

[21] Appl. No.: 271,261

[22] Filed: Nov. 15, 1988

[51] Int. Cl.[4] ..... H05B 6/78

[52] U.S. Cl. ..... 219/10.55 F; 219/10.55 E; 219/10.55 D; 99/443 R; 99/451

[58] Field of Search ..... 219/10.55 F, 10.55 E, 219/10.55 A, 10.55 D, 10.55 R; 422/309; 99/443 R, 451, DIG. 14; 126/338; 174/35 R, 35 C

[56] References Cited

U.S. PATENT DOCUMENTS

| | | | |
|---|---|---|---|
| 4,283,614 | 8/1981 | Tanaka et al. | 219/10.55 R |
| 4,725,703 | 2/1988 | Park | 219/10.55 F |
| 4,751,357 | 6/1988 | Boulard | 219/10.55 F |
| 4,773,317 | 9/1988 | Wickboldt, Jr. | 219/10.55 E |
| 4,783,582 | 11/1988 | Wada et al. | 219/10.55 R |

FOREIGN PATENT DOCUMENTS

| | | |
|---|---|---|
| 55-71489 | 5/1980 | Japan . |
| 62-111628 | 5/1987 | Japan . |

*Primary Examiner*—Philip H. Leung
*Attorney, Agent, or Firm*—Finnegan, Henderson, Farabow, Garrett, & Dunner

[57] ABSTRACT

Disclosed is a microwave heating apparatus which comprises a turntable for reducing the irregularity of heat with the rotation movement of a subject to be heated within a heat chamber, a bread casing used for automatically performing an entire process of kneading raw ingredients, fermentation, gas escape, baking and the like, a first driving shaft made of a metal pipe and provided to drive a kneading blade mounted within the bread casing, and a second driving shaft made of a microwave-permeable dielectric substance provided to drive the turntable, the second shaft being arranged to pierce a hollow portion of the first driving shaft. According to the aforementioned construction, the turntable and the kneading blade can be effectively driven by the respective optimum motors. A choke cavity and a disk shaped conductive plate prevent microwave energy from leaking out of the heat chamber along the respective driving shafts.

8 Claims, 10 Drawing Sheets

MICROWAVE OVEN HAVING AUTOMATIC BREAD MAKING FUNCTION

BACKGROUND OF THE INVENTION

1. Field of the Invention

The present invention relates to a microwave oven having an automatic bread making function, for automatically performing a bread making process from the step of kneading bread ingredients to the step of baking the same.

2. Description of the Prior Art

A microwave oven having a function for mixing food has been proposed in Japanese Utility Model Unexamined Publication No. 55-71489. This microwave oven is configured with a casing removably attached to a turntable which is rotatably provided in a heating chamber, and a mixing blade provided within the casing removably attached to a fixed shaft passed through a rotary shaft of the turntable.

In the above described microwave oven, the casing attached to the turntable is disposed to be rotated while the mixing blade is stationary. Consequently, a subject to be heated may fly out of the casing due to centrifugal force if the casing is rotated at a high speed (for example 200 r.pm. which is relatively higher than the speed of an ordinary turntable). Accordingly, there has been a problem in that the speed of the turntable in ordinary microwave heating is limited to 5–6 r.p.m. At his speed, it is difficult to achieve sufficient mixing of the subject to be heated.

On the other hand, an automatic special purpose bread making apparatus has been proposed in Japanese Patent Unexamined Publication No. 62-111628. This apparatus comprises a baking chamber having a heater, a bread casing, or bread pan, arranged to be removably mounted in the baking chamber, a kneading blade provided on an inner bottom portion of the bread casing and arranged to be driven by a motor, and a controller for controlling the bread making process, according to a temperature of the bread casing as detected by a temperature sensor. The bread casing has a rectangular horizontal section and a rib substantially vertically projected from an inner wall of the break casing at opposing sides thereof.

In this configuration, the process of kneading bread ingredients is performed, with water and flour combined with each other to form numbers of nuclei first. Those nuclei are then successively combined with each other, forming a large lump of dough. In a rectangular bread casing, flour proximate a corner of the casing, where a larger interval between the inner wall of the bread casing and the forward end of the kneading blade exists, is not mixed. In order to mix the flour proximate to the corner of the casing with the lump of dough, the kneaded lump of dough must be moved into the corner and kneaded there. In the above configuration, at two of the four corners of the rectangular bread casing, the interval between the inner wall of the bread casing and the forward end of the kneading blade narrows as the kneading blade rotates. The lump of dough is further kneaded while it is stopped by the resistance of the rib, and the flour proximate the two corners is mixed into the lump of dough. In the rmaining two corners, on the other hand, there has been a problem in that the above-mentioned interval widens in front of the corners so that the lump of dough is rotated together with the kneading blade and the flour porximate these two corners is left unmixed.

Further, in a microwave oven disclosed in Japanese Utility Model Unexamined Publication No. 61-178296, a metal rotary shaft passing through a bottom surface of a heating chamber is supported by an upper bearing made of plastic and a lower bearing made of a sintered alloy. A so-called coaxial choke comprises a cavity portion, including a bearing holder and a pipe, which acts to prevent microwave energy from leaking to the outside. Further, a packing made of silicone rubber is interposed between the bottom surface of the heating chamber and the rotary shaft to thereby prevent water drops, or the like, from entering from the heating chamber.

In the above prior art microwave oven, the above-mentioned bearings and packing are always exposed to large microwave energy, while the energy can be prevented from leaking to the outside. Since the rotary shaft and the bottom surface of the heating chamber constitute a coaxial line, microwave energy tends to leak along the rotary shaft. The leaked microwave energy is reflected by the choke and returned to the heating chamber again, so that leakage of microwave energy to the outside via this route can be prevented. However, microwave energy passing through the upper bearing and the packing cannot be prevented. Particularly, since the inlet of the choke is disposed in the vicinity of the upper bearing and the packing, the upper bearing and the packing are located at a position extremely near the position of the maximum electric field of a standing wave due to the reflection. Being made of dielectric material, as well known, the upper bearing the packing generate heat due to dielectric loss if they are put in a large electric field. Further, if food remnants, spilled soup, or the like, are deposited in the vicinity of the packing, or if such food remnants or spilled soup enter into a gap caused by rotary abrasion between the packing and the rotary shaft, heat generation may be more pronounced, or sparks may result. Since these phenomena are dangerous, a solution to this problem is required. For the same reason, it is necessary to sufficiently protect the insulator in the vicinity of the terminals of the heaters passing through the wall of the heating chamber.

SUMMARY OF THE INVENTION

It is therefore and object of the present invention to solve the above problmes in the prior art.

A further object of the present invention is to provide a microwave oven in which a driving shaft portion of a variable speed driving portion is provided proximate an inner bottom surface of a heating chamber at one end, combined with either one of a turntable and a kneading blade provided within a bread casing for performing an entire bread-making process from kneading bread ingredients to baking the same. The turntable can be driven at a low speed (for example, 5–6 r.p.m.) when the turntable is connected, and the kneading blade can be driven at a high speed (for example, 200 r.pm.).

In order to attain the above objects, according to the present invention, a microwave oven comprises: a heating chamber in which a subject to be heated is housed; a microwave oscillator for generating microwave energy; a heater for heating the inside of the heating chamber; a turntable on which the subject to be heated is put as to be rotatable within the heating chamber; a bread casing arranged to be set in the heating chamber to thereby perform an entire bread-making process from kneading bread ingredients to baking the same; a kneading blade disposed within the bread casing so as to be rotatable; a first driving shaft for rotating the kneading blade at a high speed; a kneading motor connected to the first driving shaft; a second driving shaft for rotating the turntable at a low speed; and a table motor connected to the second driving shaft; wherein the first driving shaft is formed of a hollow pipe, the second driving shaft is formed of a dielectric substance and is passed through a hollow portion of the first driving shaft so as to be coaxial with said first driving shaft, the first and second driving shafts being arranged to rotate independently of each other.

In the thus configured microwave oven, according to the present invention, the turntable provided in the heating chamber and the variable speed driving portion provided under the heating chamber act to rotate a subject to be heated at a low speed of about 5–6 r.p.m. on one hand. On the other hand, the bread casing and the variable speed driving portion provided under the heating chamber can be used as a breadmaker with the bread casing kept stationary, so that bread ingredients are kneaded by the rotating kneading blade at a high speed of about 200 r.pm. Thereafter the process of baking can be performed through a plurality of processes, for example a fermentation process, a gas-escape process, a molding fermentation process, or the like. Alternately, the invention can be used as a mixer with the kneading blade being rotated at a high speed of about 10,000 r.p.m. Further, it can be used as a kneading device for other food such as cake ingredients.

Further, according to the present invention, a bread casing support having legs is provided at a lower portion of the bread casing in order to fix the bread casing into a bottom surface of the heating chamber. A reverse-blocking member having a knocker portion is attached to the bread casing support, so that hook-like members stuck to the bottom surface of the heating chamber can be engaged with the legs of the bread casing support by turning the bread casing in the forward direction of the kneading, while the knocker portion knocks the hook-like members when the kneading blade is rotated in the reverse direction.

Further, according to the present invention, a rotary connection shaft linked to the second driving shaft is stuck to a rotary bed for removably supporting the turntable when the turntable is used, and a circular conductive plate is attached to the rotary connection shaft in order to prevent microwave energy entering a gap between the rotary bed and the bottom surface of the heating chamber from further leaking into the hollow portion and outer surrounding of the first driving shaft.

The above arrangement is advantageous in that the microwave energy entering a gap between the rotary bed and the bottom surface of the heating chamber can be suppressed from further leaking through the hole in the bottom surface of the heating chamber, thereby preventing the generation of a spark or abnormal heat, even when food remnants or spilled soup adheres to an upper portion of the first driving shaft.

Further, the microwave oven according to the present invention is configured to make bread so that a rotary shaft for rotation of the kneading blade is disposed at a center of a bottom surface of the bread casing, having a horizontal section in the form of a selected one of a regular square, a rectangle and a circle. Two ribs are provided in a plane perpendicular to the bottom surface of the bread casing and containing the center of the rotary shaft so that the ribs are extended inward from a side wall of the bread casing opposite to each other. The ribs are further arranged at the shortest distance from the shaft. The kneading blade is provided with a section perpendicular to a rotation radius in the form of an equilateral triangle having two equal sides representing the length of two kneading surfaces. Driving means for repeatedly rotating the kneading blade in the forward and reverse directions at substantially equal time rates of rotation are connectd to a lower proportion of the rotary shaft.

In the above configuration, the rotary shaft for rotation of the kneading blade is disposed at the center of the bottom surface of the bread casing, having a horizontal section in the form of a selected one of a regular square, a rectangle, and a circle. The two ribs are provided in a plane perpendicular to the bottom surface of the bread casing containing the center of the rotary shaft, wherein the ribs are extended inward from a side wall of the bread casing opposite to each other. The ribs are further arranged at the shortest distance from the shaft. The kneading blade is provided with a section perpendicular to a rotation radius in the form of an equilateral triangle having two equal sides representing the length of two kneading surfaces. The driving means for repeatedly rotating in the forward and reverse direction at substantially equal time rates of rotation are connected to a lower portion of the rotary shaft, further kneading the dough ball while it is stopped relative to the rotating direction of the kneading blade. The ball is further moved in a vertical direction of the kneading in a region in front of the two ribs opposite each other (including corner portions in the case of a bread casing having a square or rectangular section) when the kneading blade is rotating in the forward direction. The kneaded ball is further kneaded in the same manner as in the case of forward rotation of the kneading blade in another region in the rear side of the two ribs with respect to the direction of forward rotation when the kneading blade is rotating reversely. Consequently, the kneading ball is kneaded in the entire region inside the bread casing so that kneading can be performed completely, with no excess flour left unmixed at any portions in the bread casing.

BRIEF DESRIPTION OF THE DRAWINGS

Other features and advantages of the present invention will be apparent from the following description taken in connection with the accompanying drawings, wherein.

DETAILED DESCRIPTION OF THE PREFERRED EMBODIMENTS

The preferred embodiment of the present invention will be described below with reference to the drawings.

Figure 1:
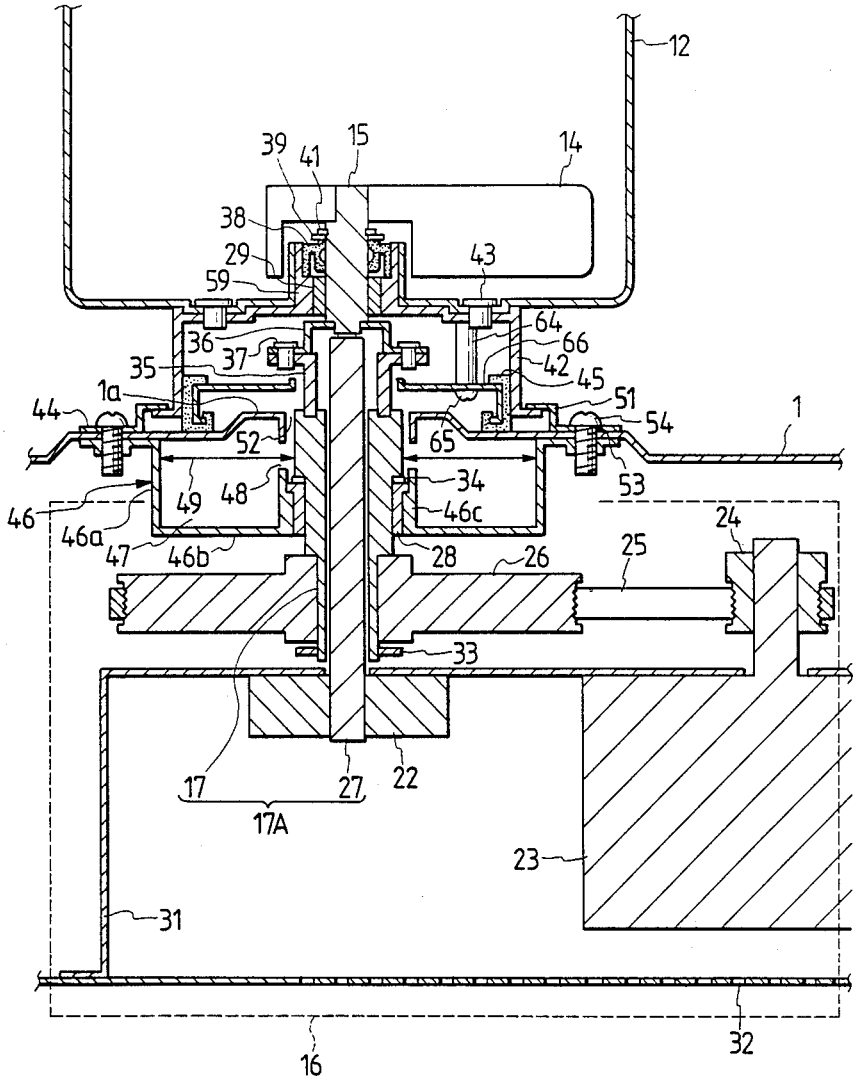
FIG. 1 is a fragmentary sectional view of a microwave heating apparatus according to a first embodiment of the present invention.
Figure 2:
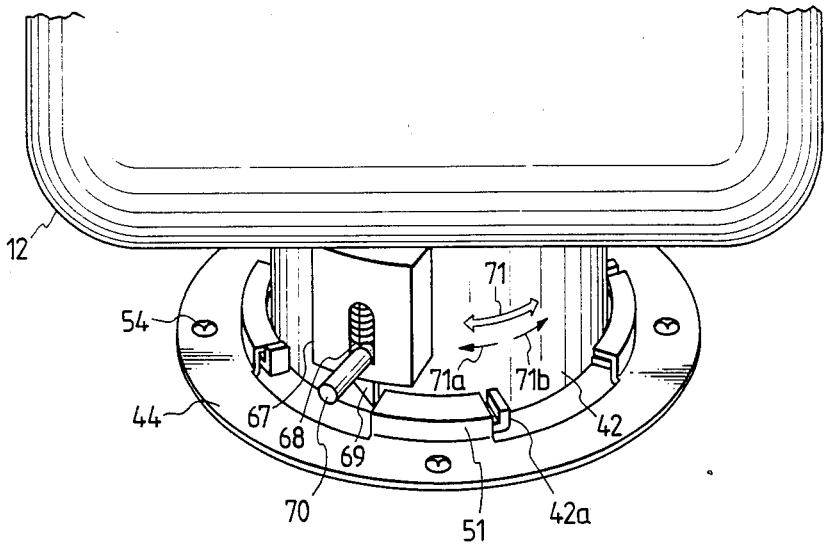
FIG. 2 is a partial perspective view of FIG. 1.
Figure 3:
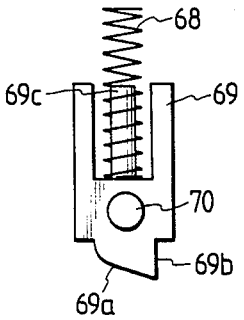
FIG. 3 is an enlarged plan view of a knocker portion of the embodiment shown in FIG. 2.
Figure 4:
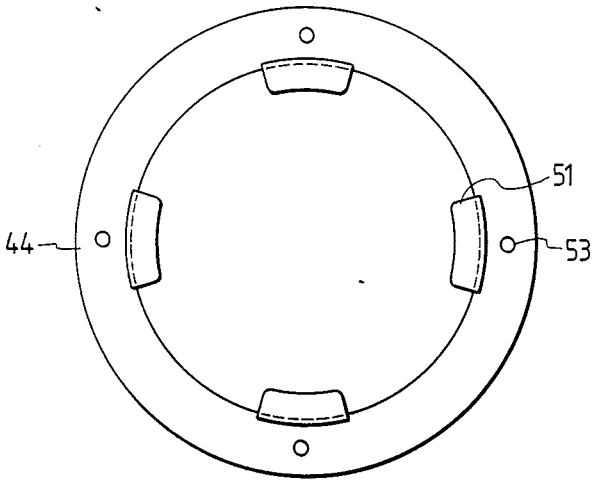
FIG. 4 is an enlarged top plan view of a fixing member portion of the embodiment shown in FIG. 1.
Figure 5:
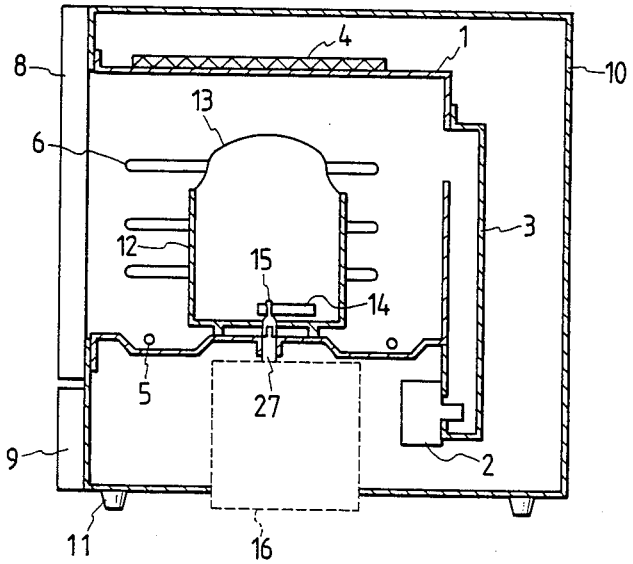
FIG. 5 is a sectional view of a primary section of the microwave heating apparatus when used as a breadmaker.
Figure 6:
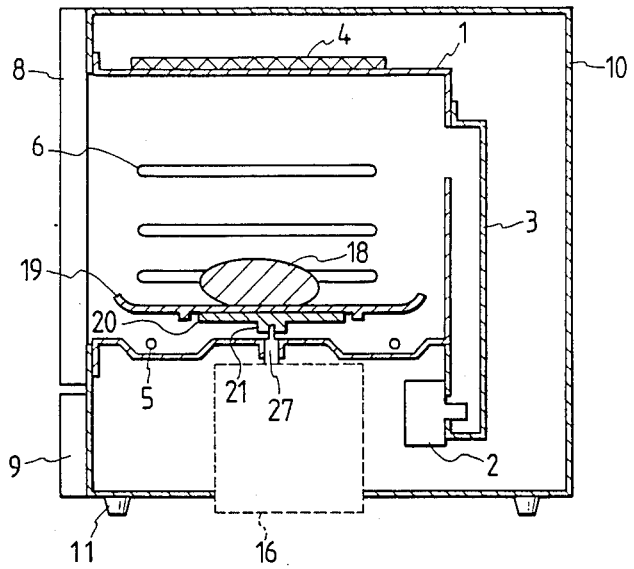
FIG. 6 is a sectional view of a primary section of the microwave heating apparatus when used as a microwave oven including a turntable.
Figure 7:
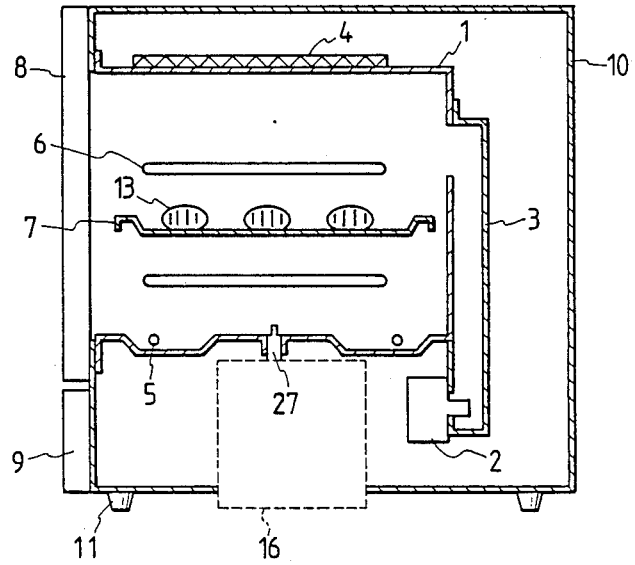
FIG. 7 is a sectional view of a primary section of the microwave heating apparatus when used as an electric oven including a substantially square tray.

FIG. 1 is a fragmentary sectional view of an embodiment of the microwave oven according to the present invention. FIG. 2 is a partial perspective view showing a part of the apparatus depicted in FIG. 1. FIG. 3 is an enlarged plan view of a knocker portion of the embodiment depicted in FIG. 2. FIG. 4 is an enlarged top plan view of another part of the apparatus depicted in FIG. 1. FIGS. 5 to 7 are partial sectional views showing a primary portion of the apparatus, depending on which purpose the invention is serving.

In the drawings, a heating chamber 1 is provided in the microwave oven, and a microwave oscillator 2 is provided for supplying microwave energy into the heating chamber 1 through a waveguide 3 to heat the inside of food dielectrically. An upper heater 4, and a lower heater 5, each of which serves as a heat source, are used for baking or roasting food in oven cooking such as cake making, bread making or the like. A ledged portion 6 supports a square tray 7 (FIG. 7) used in oven cooking. A door 8 for opening and closing the front entrance of the heating chamber 1, and an operation panel 9 for controlling heat are provided. An outer casing 10, and legs 11 attached to the bottom of the outer casing 10 are provided. A bread casing 12 is provided for kneading bread ingredients 13, such as wheat flour, yeast, water and the like, and for baking bread with heat from the microwave energy and the heaters. A kneading blade 14 is disposed in the lower part of the bread casing 12 so as to be rotatable within the bread casing 12. A shaft 15 is provided to rotate the kneading blade 14.

In FIG. 1, a variable-speed driving portion 16 having a low-speed motor 22 and a high-speed motor 23 acts as a driving source. The low-speed motor 22 serves to rotate a turntable 19 (FIG. 6) at a low speed of 5 to 6 r.p.m. with a subject 18 placed on the turntable 19. The high-speed motor 23 serves to rotate the kneading blade 14 at a high speed of about 200 r.pm. during bread making while using the bread casing 12. A first driving shaft 17 is provided for transmitting the rotation force of the high-speed motor 23 to the shaft 15 of the kneading blade 11 through a small pulley 24, a belt 25 and a large pulley 26. The first driving shaft 17 is formed of a metal pipe. A second driving shaft 27 is provided for transmitting the rotation force of the low-speed motor 22 to a rotary connection shaft 21 of a rotatary bed 20 for rotatably supporting the turntable 19 as shown in FIG. 6. The second driving shaft 27 is formed of a microwave transmissible dielectric substance. A shaft bearing 28 is provided for the first driving shaft 17, and a shaft bearing 29 is provided for the shaft 15. The shaft bearings 28 and 29 can be formed, although without limitation, of sintered metal or the like. The second driving shaft 27 passes through a hollow portion of the first driving shaft 17 and then passes through a hole 52 piercing the bottom of the heating chamber 1. The internal diameter D of the hollow portion of the first driving shaft is established to be smaller than the cut-off size $\lambda/(1.7\sqrt{\epsilon r})$ in which $\lambda$ represents the wavelength of microwave used, and $\epsilon$ represents the specific permittivity of the second driving shaft 27. In other words, the diameter D and the specific permittivity $\epsilon r$ are selected to satisfy the following relation (1) for the wavelength $\lambda$ used.

$$D < \lambda/(1.7\sqrt{\epsilon_r}) \tag{1}$$

How the microwave energy is prevented from leaking out of the heating chamber 1 through the hollow portion of the first driving shaft 17 pierced by the second driving shaft 27 is described below.

If the wavelength $\lambda$ is 122 mm (corresponding to the frequency 2.45 GHz) and the specific permittivity $\epsilon r$ of the second driving shaft is 4, then the cut-off size $\lambda/(1.7\sqrt{\epsilon r})$ is 36 mm. It is necessary for practical use that the internal diameter D of the hollow portion of the first driving shaft 17 be about 10 mm. The internal diameter D is smaller than the cut-off size which is 36 mm. In the cut-off condition, a slight quantity of microwave energy enters into the hollow portion of the first driving shaft. The microwave energy attenuation per unit length $\alpha$ is represented by the equation (2):

$$\alpha = 2\pi \times 8.69\sqrt{\left(\frac{1}{1.7D\sqrt{\epsilon_r}}\right)^2 - \left(\frac{1}{\lambda}\right)^2}\ [\text{dB/mm}] \tag{2}$$

in which the gap between the inner wall of the hollow portion of the first driving shaft 17 and the outer surface of the second driving shaft 27 is neglected.

By substituting the values $\lambda=122$ mm, $D=10$ adn $\epsilon r=4$ into the equation (2), $\alpha=1.5$ dB/mm is obtained. When the heating chamber 1 is surrounded by an outer casing 10 made of an electrical conductor, it is sufficient that the attenuation per leaking-direction total length is not less than about 20 dB. It is therefore apparent from the equation (2) that the attenuation per total length can be established at not less than 20 dB when the vertical-direction (leaking-direction) length of the hollow portion of the first driving shaft 17 is not smaller than 13 mm. Therefore, microwave energy leakage can be prevented sufficiently for practical use.

A driving shaft portion 17A comprises the first driving shaft 17 and the second driving shaft 27. A motor mount 31 is used for mounting the low-speed motor 22 and the high-speed motor 23. A fresh-air inlet 32 permits outside air to enter into the motor mount 31 in order to cool electric parts. A stop ring 33 fixes the large pulley 26 to the first driving shaft 17. A hollow disc 34 receives the thrust load of the first driving shaft 17. A movable member 35 is attached to the lower portion of a fitting 36 (fixed to the shaft 15 for the purpose of preventing the shaft 15 from disconnecting upward) by a rivet 37 or the like. The movable member 35 is fitted to an upper portion of the first driving shaft 17 to form a claw clutch. An oil seal 38 is formed of silicone rubber or the like for preventing the bread ingredients 13, especially liquid, from dropping out of the bread casing 12. A firctionless washer 39 is made of fluoroplastics for providing a seal for an extended time against mechanical impulse applied onto the oil seal 38. A stop ring 41 prevents the oil seal 38 and the washer 39 from disconnecting. A bread casing support 42 is provided for supporting the bread casing 12 at the bottom surface of the heating chamber 1. Rivets 43 fix the bread casing 12 onto the support 42. A shaft bearing 29 of the shaft 15 for rotation of the kneading blade 14 is forced into a shaft bearing holder 59 formed together with the support 42. A fixing member 44 is provided to removably fix the support 42 to the bottom surface of the heating chamber 1. As shown in FIG. 4, the fixing member 44 is formed by drawing the same material, for example SUS 304 metal plate, as that of the bottom of the heating chamber 1. Hook-like members 51 are provided for fastening the lower end portion of the support 42 of the bread casing 12. Holes 53, in which stop screws 54 are inserted, snug the surroundings of the fixing member 44 to the bottom surface of the heating chamber 1. A shock absorber 45, made of silicone rubber, prevents noise from occurring due to vibration during the rotation of the kneading blade 14. The shock absorber 45 is fixed to the lowermost portion of the support 42 by an absorber support 66, which is fixed to a prop 64 of the support 42 by a screw 65. A choke cavity 47 is surrounded by metal walls to prevent microwave energy from leaking out of the heating chamber 1 along the outer circumference of the first driving shaft 17. The choke cavity 47 has a larger diameter in a direction perpendicular to the first driving shaft 17 than the axial-direction thickness of the first driving shaft 17 to form a so-called "radial line". The predetermined height of the lower portion of the heating chamber 1 is thereby reduced to attain a smaller-sized microwave oven. Microwave energy entering an inlet 48 of the choke cavity 47 advances towards a cylindrical wall 46a and is then reflected from the cylindrical wall 46a to the inlet 48. The length of microwave propagation path 49 in the choke cavity 47 is about $\lambda/4$.

The cavity walls 48 (a cylindrical wall 46a and a bottom wall 46b) in the choke cavity 47 are united with a shaft bearing holder 46c for holding the shaft bearing 28.

As shown in FIG. 2, by turning the bread casing 12 in a predetermined direction of rotation of the kneading blade 14 (in the attachment or stop direction 71*a* of the arrow 71), the legs 42*a* of the bread casing support 42 are engaged with the hook-like members 51 stuck to the bottom surface of the heating chamber 1. Further, a reverse-blocking device 67 having a knocker portion 69*b* which knocks against a side of the hook-like member 51 when the kneading blade 14 is turned in a reverse direction (in the detachment direction 71*b* of the arrow 71), is attached to the support 42 to prevent the bread casing 12 from detaching from the support 42 during the kneading operation. The reverse-blocking device 67 is composed of a movable member 69, which is urged downward by a reverse-blocking spring 68, and a knob 70 for pushing up the movable member 69 against the spring 68 to make the lower end of the movable member 69 higher than the position of the hook-like member 51, thereby permitting the bread casing 12 to turn in the detachment direction of the arrow 71.

FIG. 3 shows an example of the form and positional relation of the compression spring 68, the movable member 69 and the knob 70. In FIG. 3, the movable member 69 comprises a metal plate including a taper portion 69*a* for sliding on the upper surface of the hook-like member 51 when the bread casing 12 is turned in the stop direction 71 of the arrow 71, a knocker portion 69*b* for knocking against the side of the hook-like member 51 when the kneading blade 14 is turned in the reverse direction 71*b* of the arrow 71 during the kneading operation, and a spring keeper portion 69*c* for keeping the compression spring 68. The knob 70 is fixed perpendicularly to the movable member 69.

The operation of the aforementioned embodiment is described below.

When baking bread by using the bread casing 12, the bread casing 12 is set in the heating chamber 1 as shown in FIG. 5 in the same manner as in a breadmaker. The kneading blade 14 is rotated at a speed of about 200 r.pm. by the high-speed motor 23 of the variable speed driving portion 16 to thereby knead bread ingredients 13 contained in the bread casing 12. The bread ingredients 13 are suitably heated with microwave energy and with heat by the upper and lower heaters 4 and 5, respectively. Thus, bread making can be perfected in a short time through a fermentation process, gas-escape process due to the rotation of the kneading blade 14 for several seconds, or the like. In this case, bread thus baked is provided as a loaf of bread having a section including the shape corresponding to the bread casing 12 and the shape of an arc as swollen from the bread casing 12. When different-shaped bread is desired, for example rolls, the process of bread baking is as follows. The bread casing 12 is taken out of the heating chamber 1 after bread ingredients 13 are kneaded and fermented in the bread casing 12. The bread ingredients 13 are divided, shaped, and placed on the square tray 7. Thus, the bread making process from fermentation to baking can be completed as shown in FIG. 7 in the same manner as in an electric oven or combination microwave oven.

When the turntable 19 is used, the turntable 19 on which the subject 18 is placed, and the rotary bed 20 for supporting the turntable 19, are set in the heating chamber 1 as shown in FIG. 6. Thus, the cooking of the subject 18 can be made with microwave energy supplied from the microwave oscillator 2 to the heating chamber 1, or with heat supplied from the upper and lower heaters 4 and 5, in the same manner as in a simple microwave oven or a combination microwave oven.

Although this embodiment has shown the case where the upper and lower heaters 4 and 5 are used as a heating source, the invention can also be applied when an outside electric or gas heater for introducing heating air from a source exterior to the heating chamber 1 is used.

Further, the forward and reverse rotation of the kneading blade 14 can be suitably carried out because the reverse-blocking member 67 is attached to the support 42 of the bread casing 12. Acocrdingly, the kneading capability can be improved with respect to any bread casing 12, for example a square casing, having a shape in which kneading is normally difficult to perform.

According to this embodiment, any suitable one of the kneading blade within the bread casing used for the bread-making process from kneading to baking, and the turntable, can be selectively connected to the corresponding driving shaft of the variable-speed driving portion provided at the bottom surface of the heating chamber. Accordingly, high-speed rotation, for example, 200 r.pm. and low-speed rotation, for example, 5–6 r.p.m., can be applied to the kneading blade and the turntable, respectively. In other words, the kneading blade and the turntable can be effectively driven by the respective optimum motors, so that a suitable cooking operation can be performed in accordance with the desired purpose. Further, the bread casing support for fixing the bread casing to the bottom surface of the heating chamber is arranged at the lower portion of the bread casing so that, in the case where the bread casing is turned in the forward direction of rotation of the kneading blade, the legs of the support can be engaged with the hook-like members stuck to the bottom surface of the heating chamber. Further, the reverse-blocking member having the knocker portion for knocking against one hook-like member in the case where the kneading blade is turned in the reverse direction, is attached to the support. Accordingly, the forward and reverse rotation of the kneading blade can be suitably carried out. Consequently, kneading capability can be improved with respect to any bread casing, for example a square casing, having a shape in which it is normally difficult to perform kneading.

Further, the second driving shaft for driving the turntable is encompassed by the first driving shaft for driving the kneading blade. This is because the first driving shaft is pierced by the second driving shaft at the hollow portion of the first driving shaft. Therefore the kneading blade and the turntable can be effectively driven by the respective optimum motors. Accordingly, a more compact mechanism can be attained.

Further, the triple functions of microwave oven, electric oven and breadmaker can be carried out by one apparatus. Consequently, this embodiment is very advantageous in economy and space saving.

In the following, a second embodiment of the present invention is described with reference to FIGS. 8 through 15.

The second embodiment relates to an alternate configuration of the apparatus according to the first embodiment of the invention, in which the bread casing is replaced by a turntable.

The second embodiment is similar to the first embodiment, except that there is further provided a rotary connection shaft fixed to the rotary bed for both removably supporting the turntable and engaging the second driving shaft, and a circular conductive plate attached to the rotary connection shaft for preventing microwave energy from entering into the hollow portion and outer circumference of the first driving shaft at the space between the rotary bed and the bottom surface of the heating chamber.

Figure 8:
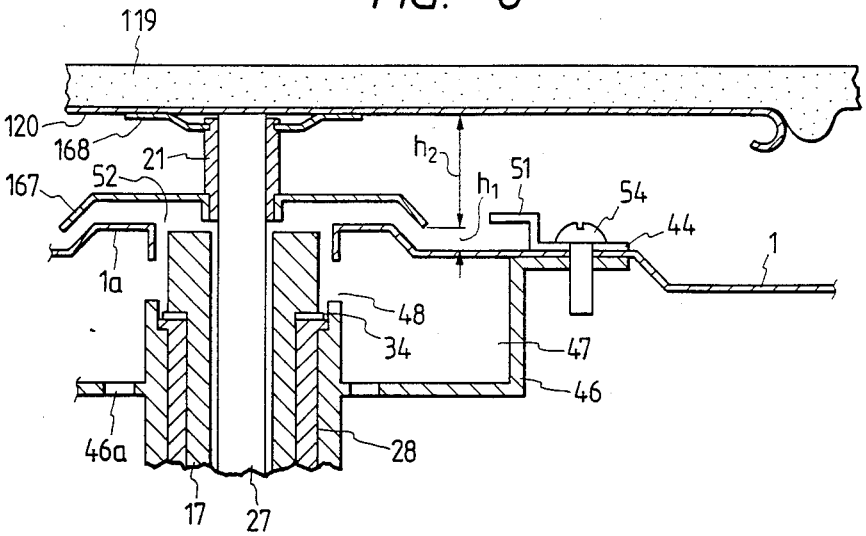
FIG. 8 is a fragmentary enlarged sectional view showing the turntable mounting structure as a second embodiment of the present invention.

FIG. 8 shows the second embodiment configured with the bread casing replaced by a turntable in the apparatus according to the first embodiment of the invention.

In FIG. 8, a connection plate 168 connects the rotary bed 20 and the rotary connection shaft 21 to each other. A circular conductive plate 167 is fixed to the rotary connection shaft 21. The circular conductive plate 167 serves to prevent microwave from entering into the hole 52 at the space between the rotary bed 20 and the bottom surface of the heating chamber 1. The diameter of the circular conductive plate 167 is established to be larger than the diameter of the hole 52.

In FIG. 8, $h_1$ represents the distance between the circular conductive plate 167 and the bottom surface of the heating chamber 1, and $h_2$ represents the distance between the circular conductive plate 167 and the rotary bed 20. As the value of $h_1/h_2$ decreases, the microwave energy entering into the hole 52 at the space between the rotary bed 20 and the bottom surface of the heating chamber 1 correspondingly decreases. In the case where the diameter of the circular conductive plate 167 is larger than the diameter of the hole 52, the microwave energy is separated into upper and lower parts by the circular conductive plate 167 and then reaches the upper portion of the first driving shaft 17. Accordingly, there is no occurrence of sparking and abnormal heating, even if food remnants or spilled soup is deposited on the upper portion of the first driving shaft.

The second embodiment is based on the following idea of the inventors of this application.

A disc-shaped conductive plate is attached to the heating chamber side of conductors piercing the wall of the heating chamber, such as driving shafts, heaters and the like. In other words a collar-like plate is attached to the heating chamber side of the conductors, thereby reducing the amount of microwave passed through insulators, a conductor, shaft bearings packing, and heater terminals, thus providing a safe microwave oven without abnormal heating and sparking.

In general, in the case where a hole provided in a plate-like conductor is pierced by a feedthrough conductor having a smaller diameter than that of the plate-like conductor without contact between the conductors, microwave energy reaching one side partly leaks into the opposite side through the feedthrough conductor. In this case, as surface current flowing in the feedthrough conductor in the vicinity of the hole increases, the amount of microwave leakage increases. Because the aforementioned collar-like circular conductive plate serves to reduce the surface current, the leaking microwave energy can be reduced. Accordingly, the aforementioned microwave energy passed through the shaft bearings and packings can be reduced.

Figure 9:
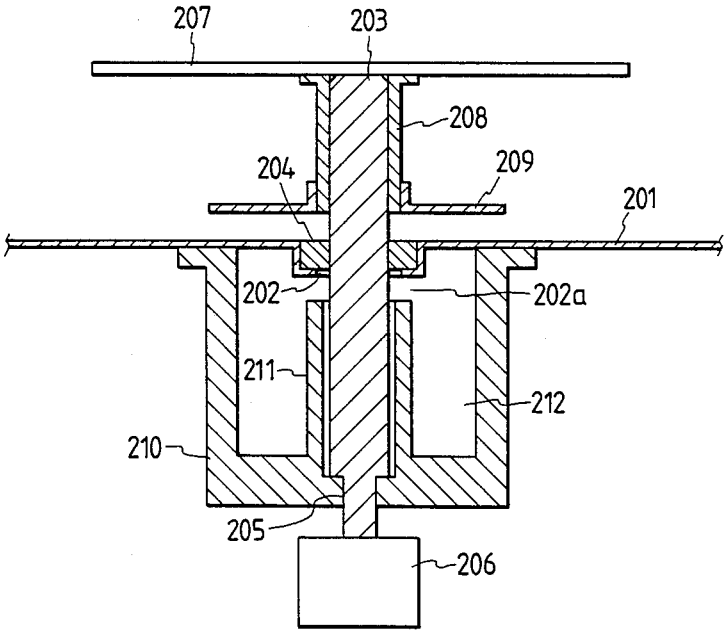
FIG. 9 is a schematic sectional view further explaining the second embodiment.

FIG. 9 shows a simplified arrangement of the second embodiment. The arrangement and operation of the second embodiment according to the present invention will become apparent in the following description with reference to FIGS. 9 through 14.

In FIG. 9, a bottom surface of the heating chamber is designated 201. A hole 202 provided substantially at the center of the bottom surface 201 is pierced by a metal shaft 203. The shaft 203, supported by an upper shaft bearing 204 and a lower shaft bearing 205, serves to transmit the rotation force of a rotational driving source 206 to a rotary bed 207 and support the rotary bed 207 through a metal shaft bearing 208 attached to the rotary bed 207. The rotary bed 207 and the shaft bearing 208 are united with each other to form one body removably mounted to the shaft 203. A circular conductive plate 209 (hereinafter called an "inhibit disc") is attached to the shaft bearing 208. The inhibit disc 209 is made of a metal and arranged to face the heating chamber bottom surface 201 at a predetermined distance. On the inner side of the choke construction 201, a pipe 211 is provided to form a so-called "coaxial line" comprising the shaft 203 acting as an inner conductor and the pipe 211 as an outer conductor. On the outer side of the choke construction 201, a cavity 212 having a length equal to about a quarter of the used microwave is provided to form a so-called "coaxial choke" having a choke inlet 202*a*.

According to the aforementioned structure, leaking microwave energy enters the space between the inhibit disc 209 and the heating chamber bottom surface 201 and is transmitted to the hole 202 through the upper shaft bearing 204. Then, the leaking microwave energy tries to propagate in the coaxial line at the inner side of the pipe 211, but cannot propagate in the coaxial line because of the choke. Accordingly, the microwave energy is reflected from the choke inlet 202*a*, so that the microwave energy is returned to the heating chamber through the reverse course.

In short, the path of leaking microwave is the same as in the prior art. However, the leaking microwave energy can be remarkably reduced because of the existence of the inhibit disc 209. When the leaking microwave energy is reduced, the occurrence of abnormal heating and sparking caused by food remnants deposited on the upper shaft bearing 204 and the packing (not shown) can be prevented.

The operation of the inhibit disc 209 is described below.

Figure 10:
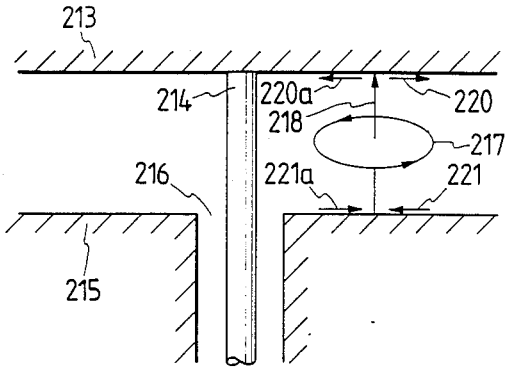
FIG. 10 is a schematic view depicting the effect of FIG. 9.

Before the operation of the inhibit disc 209 is described, the case where the inhibit disc 209 is absent will be described with reference to the condition when a part of microwave within the heating chamber leaks outward (downward) from the hole 202 through the shaft 203. FIG. 10 is a schematic showing the rotary bed and its vicinity simplified for illustration. In FIG. 10, an upper conductor 213 is equivalent to the rotary bed 207, and a conductor rod 214 is equivalent to the shaft 203. A lower conductor 215 is equivalent to the heating chamber bottom surface 201. The portion under a coaxial inlet 216 forms a coaxial line including the conductor rod 214 acting as an inner conductor.

It is now assumed that microwave energy represented by magnetic field 217 and electric field 218 comes from the right in FIG. 10. The form of microwave energy conceptually simplified for illustration is shown in FIG. 10. If the distance between the upper conductor 213 and the lower conductor 215 is smaller than one half the wavelength of the used microwave, the electric field 218, in fact, has nothing but a perpendicular component with respect to the upper and lower conductors 213 and 215. Accordingly, the magnetic field 217 has nothing but a parallel component with respect to the upper and lower conductors 213 and 215, because the magnetic field 217 occurs around the electric field 218. Consequently, surface currents as represented by the arrows 220, 220*a*, 221 and 221*a* flow in the conductors radially from the electric field 218.

Figure 11:
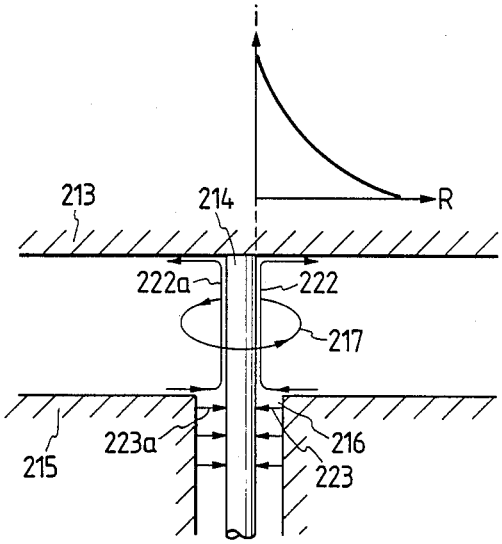
FIG. 11 is a schematic view further depicting the effect of FIG. 9.

FIG. 11 shows the condition in which the magnetic field 217 and the conductor rod intersect each other with the advance of the microwave to the conductor rod 214. When the conductor rod 214 is surrounded by the magnetic field 217, the electric field 218 disappears and surface currents, represented by the arrows 222 and 222*a*, flow in the conductor rod 214. Because the conductor rod 214 and the upper conductor 213 are electrically connected to each other, the surface currents 222 and 222*a* flow in the surface of the upper conductor 213. Because the surface currents flow in this portion radially from the axis of the conductor rod 214, the current density i decreases rapidly as the radial-direction distance R increases. In short, the current density i becomes largest in the vicinity of the conductor rod 214. Although surface currents from the lower conductor 215 try to go toward the conductor rod 314 in the same manner as described above, such surface currents cannot flow in the conductor rod 214 because the lower conductor 215 is different from the upper conductor 213 in that the coaxial inlet 216 does not serve as a conductor. Accordingly, displacement currents, that is, electric fields 223 and 223*a*, arise and propagate downward through the coaxial line. The downward propagating microwave is the same as described above with reference to FIG. 9 in which microwave energy propagates downward through the upper shaft bearing 204 and the hole 202. The microwave energy is considerably large because the surface current density i becomes largest at the coaxial inlet 216. It is a matter of course that the magnetic field (not shown) corresponding to the electric fields 223 and 223*a* exists in the lower coaxial line of FIG. 11, wherein the magnetic field surrounds the conductor rod, and surface currents flow in the axial directions of the inner and outer conductors, respectively.

Although a part of the microwave energy coming from the right can propogate downward as described above, the remaining part of the microwave energy is partly transmitted to the left and partly returned to the right by reflection, neglecting loss in the conductor rod 14. Consequently, the remaining part of the microwave energy is radiated from the conductor rod 14 again.

Although the above described has shown the leakage of microwave out of the hole in the case where the inhibit disc is absent, the leakage of microwave in the case where the inhibit disc 209 is provided will be shown in the following description.

Figure 12:
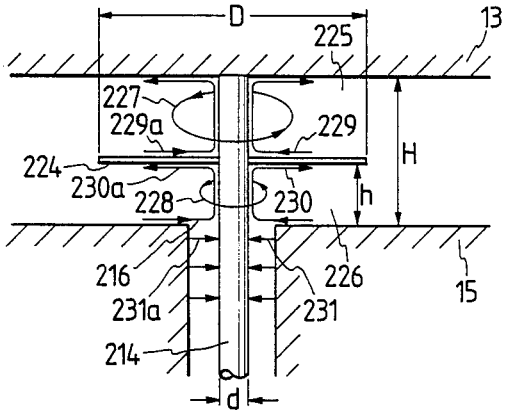
FIG. 12 is a schematic view still further depicting the effect of FIG. 9.

FIG. 12 is a view of a simplified arrangement in the same manner as in FIG. 10. In FIG. 12, a conductor disc 24 equivalent to the inhibit disc 209 is attached to a conductor rod 214 at a distance h between the conductor disc 224 and a lower conductor 215. When the magnetic field 217 and the electric field 218 (not shown in FIG. 12) come from the right in the same manner as in FIG. 10, the magnetic field 217 and the electric field 218 advance to the conductor rod 214 in upper and lower regions 225 and 226 divided by the conductor disc 224. The magnetic fields 227 and 228 having reached the conductor rod 214 respectively intersect the conductor rod 214, so that surface currents 229, 229*a*, 230 and 230*a* are passed. A part of the electric power as represented by the electric fields 231 and 231*a* is proposed to the lower coaxial line by surface currents 230 and 230*a*. However, surface currents 229 and 229*a* on the region 225 side have no effect on the lower coaxial line. In the region 225, microwave energy having reached the conductor rod 214 behaves as follows. The microwave energy in the region 225 is partly transmitted to the left and partly returned to the right and radiated again.

Accordingly, downward propagating microwave energy is reduced as the microwave entering into the region 226 decreases. When the distance between the upper conductor 213 and the lower conductor 215 is represented by H, it is apparent from the form of the magnetic and electric fields that the microwave having reached the conductor rod 214 partly advances to the region 226 by h/H of the energy thereof and that the remainder advances to the region 225. In short, downward propagating microwave energy decreases as h decreases.

Figure 13:
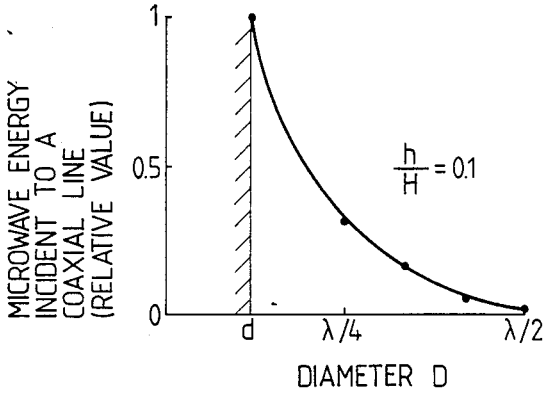
FIG. 13 is a characteristic graph showing the measurement results of FIG. 9.

Further, the diameter D of the conductor disc 224 must be somewhat large. If D is small, the energy division cannot be carried out sufficiently. Also if D is small, the surface currents 229, 229*a*, 230, and 230*a*, respectively flowing in the front and rear surfaces of the conductor disc 224 as shown in FIG. 12, are connected to each other in the edge portion of the conductor disc 224 before the surface currents 229, 229*a*, 230, and 230*a* are reduced sufficiently to justify the existence of the conductor disc 224. A result of confirming this fact experimentally is shown in FIG. 13, in which, after the choke structure under the heat chamber bottom surface 201 in FIG. 9 is replaced by a simpler coaxial line, the microwave energy incident to the coaxial line is measured. If the inhibit disc 209 is not used, the microwave energy incident to the coaxial line (which takes the value of 1 in the case of D=d) rapidly decreases as D increases. The decrease of the incident electric power leads to inhibition of abnormal heating and sparking due to food remnants deposited on the upper shaft bearing 204, aforementioned packing and their environs. It is possible to consider that there is no matter in practical application when D is larger than one quarter of the used microwave. Although FIG. 13 shows data in the case where h is one-tenth as much as H, investigation shows that a sufficient effect can be attained when h is not larger than one-tenth as much as the wavelength.

Figure 14:
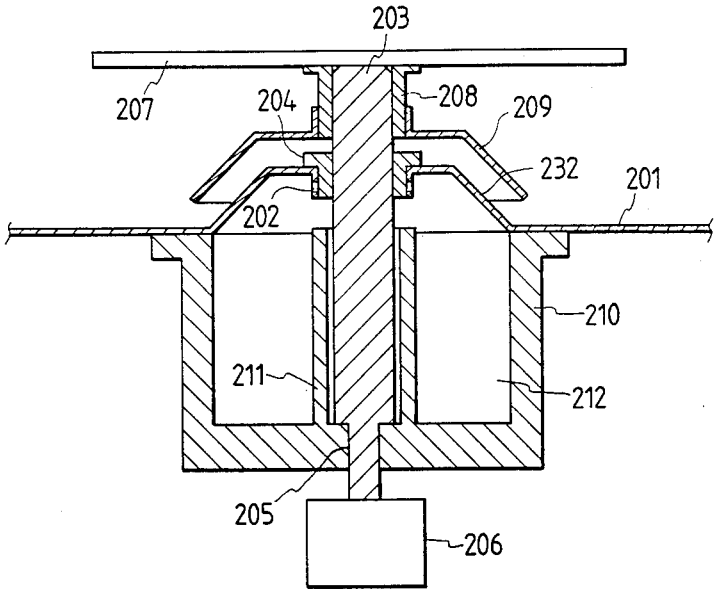
FIG. 14 is a schematic view further explaining the second embodiment.

For simplification of illustration, FIGS. 9 to 13 show the case where the inhibit disc 209 is flat and not projecting. However, in the case where a projecting portion 232 is arranged in the heat chamber bottom surface 201 in the vicinity of the hole 202 as shown in FIG. 14, the inhibit disc 209 may be configured in a substantially conical shape along the inclination of the projecting portion 232. In short, the same effect as in FIG. 9 can be attained by keeping the distance between the projecting portion 232 and the inhibit disc 209 almost constant and sufficiently narrow.

Accordingly, even in the case where the inhibit disc 67 shaped consequently conical as shown in FIG. 8 is used in the second embodiment of the present invention, the microwave energy entering into hole 52 can be inhibited.

Although the aforementioned- embodiment has shown the case where metal is used as a material for a matter piercing the hole 202, the invention is not limited to this specific embodiment. For example, the same effect can be attained when using ceramics.

Figure 15:
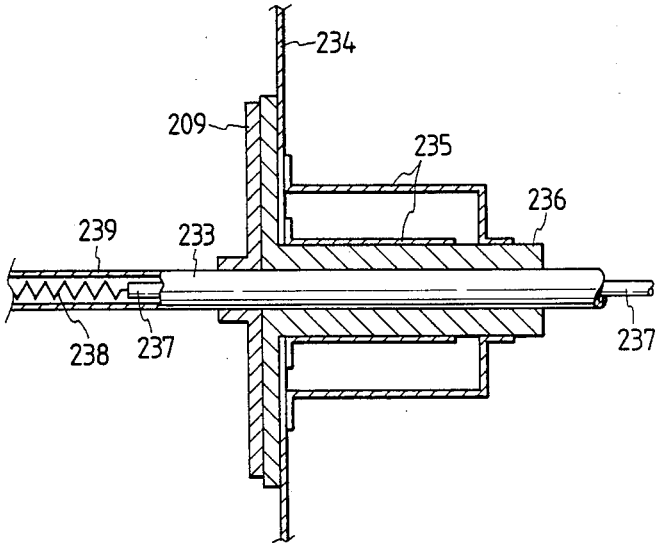
FIG. 15 is a sectional view showing another example of an application of the second embodiment.

FIG. 15 shows a modification to which the basic concept of the aforementioned embodiment is applied. In FIG. 15, the heat chamber bottom surface 234 is pierced by a heater 233 of a combination microwave oven having an oven function for heating food by heat radiation of the heater, instead of the rotary bed. When the over is used as a microwave oven, the leakage of microwave energy occurs in the same manner as in the case of the rotary bed. To prevent this leakage, a choke construction 235 is provided. An insulator 236 electrically insulates the choke construction 235, and the heat chamber bottom surface 234 is provided for safety in the case where insulation of the lead wire 237 or heating element 238 from the outer cover 239 is deteriorated by some cause. Inhibit disk 209 is fixed to the heater 237 with insulator 236 between the inhibit disc 209 and the heat chamber bottom surface 234. If there is no inhibit disc 209, the insulator 236 may heat as described above. The inhibit disc 209 prevents the heating of the insulator 236 effectively.

Consequently, according to the concept of this embodiment, microwave energy passing through the heater terminal insulator as well as the upper shaft bearing and the packing can be reduced to prevent the occurrence of abnormal heating and sparking, thereby providing a safe microwave heating apparatus.

In the following a third embodiment of the present invention is described with reference to FIGS. 16 through 20.

The third embodiment relates to an arrangement in the case where the apparatus of the first embodiment is used for bread making.

The third embodiment is formed by modifying the first embodiment as follows.

In the microwave oven of this embodiment, a rotary shaft for rotation of the kneading blade is provided at a center of a bottom surface of the bread casing having a horizontal section in the form of a selected one of a regular square, a rectangle and a circle. Two ribs are provided in a plane perpendicular to the bottom surface of the bread casing and containing the center of the rotary shaft so that the ribs are extended inward from the side wall of the bread casing opposite to each other. The ribs are further arranged at the shortest distance from the shaft. The kneading blade is provided with a section perpendicular to a rotation radius in the form of an equilateral triangle having two equal sides representing the length of two kneading surfaces, and the kneading blade alternately rotates in the forward and reverse direction at substantially equal time rates of rotation.

As described above, FIG. 1 shows a configuration in which the apparatus of the first embodiment is used for bread making. That is, FIG. 1 can shows the third embodiment of the present invention. However, for clarifying the third embodiment, FIG. 17 is provided to show the arrangement of the third embodiment.

Figure 17:
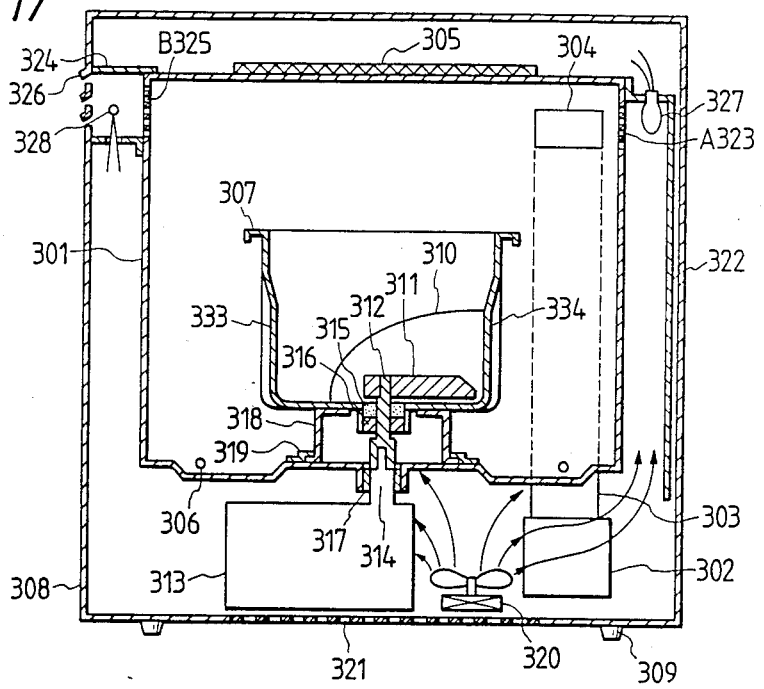
FIG. 17 is a schematic sectional view showing the bread mold set in the microwave heating apparatus (combination microwave oven)

FIG. 17 shows a heat chamber 301 provided in the microwave heating apparatus. A microwave oscillator 302 supplies microwave energy into the heat chamber 301 through a wave guide 303 and a feeder port 304, to heat the inside of food directly dielectrically. An upper heater 305 is provided at an upper portion of the heat chamber 301, and a lower heater 306 is arranged under the bottom surface of a bread casing 307 when the bread casing 307 is set in the heat chamber 301. Each of the heaters serves as a heat source to be used for bread baking. An outer casing 305 serves as a shell of the microwave heating appartus, and legs 309 are attached to the bottom surface of the outer casing 308. A kneading blade 311 for kneading bread ingredients 310 such as wheat flour, yeast, water and the like, is rotatably attached to the bread casing 307. A shaft 312 for rotation of the kneading blade 311 is removably connected to a driving shaft 314 of a variable-speed driving portion 313 composed of a motor, a pulley and a gear. The shaft 312 pierces the center of the bottom of the bread casing 307 to form a feedthrough portion which includes an oil seal 315 and a shaft bearing 316. A shaft bearing 317 is provided around the driving shaft 314 and fixed to the lower portion of the bottom of the heat chamber 301. A support 18 for supporting the bread casing 307 on the bottom surface of the heat chamber 301 is fixed to the lower surface of the bread casing 307. The support 318 is removably supported by a fitting chamber 319 fixed to the bottom surface of the heat chamber 301. A cooling fan 320 cools the microwave oscillator 302 by taking in outside air through an air inlet 321 provided in the outer casing 308. The refrence numeral 322 designates an air duct for sending air from the cooling fan 320 to the heat chamber 301 through a ventilation device A323. An exhaust duct 324 exhausts a part of steam or hot air out of the heat chamber 301 through another ventilation device B325 and exhaust apertures 326. An illumination lamp 327 is provided in the air duct 322. The illumination lamp 327 throws light over the heat chamber 301 through the ventilation device A323 provided in the wall of the heat chamber 301. A thermosensor 328 is provided indirectly detecting the temperature of the heat chamber 301.

Figure 18:
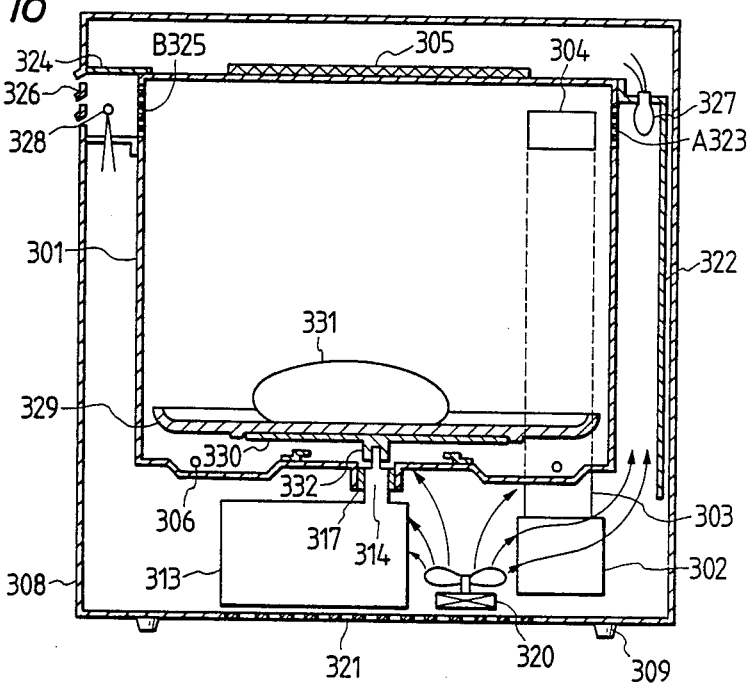
FIG. 18 is a schematic sectional view showing the bread mold of FIG. 17 replaced by a turntable.

FIG. 18 shows the case where the bread casing 307 is replaced by a turntable 329. In FIG. 18, a rotary bed 330 rotatably supports the turntable 329 with a subject 331 to be put thereon. A shaft 332 for rotation of the rotary bed 330 is removably engaged with the driving shaft 314 for the driving portion 313.

Figure 16:
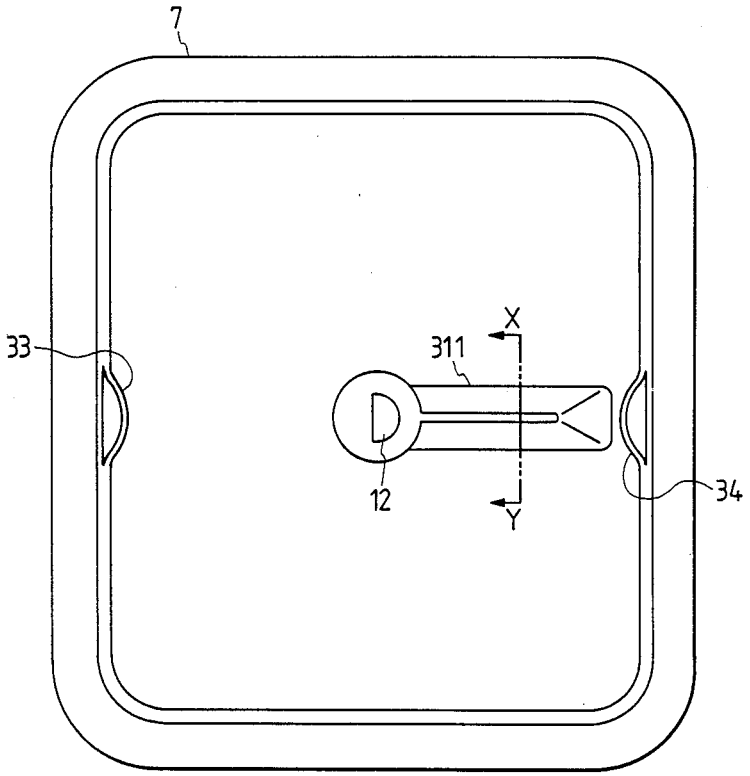
FIG. 16 is a plan view of a bread mold in the microwave heating apparatus as a third embodiment of the present invention.
Figure 19:
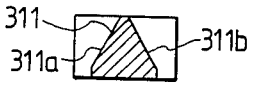
FIG. 19 is a sectional view taken along the line X-Y of FIG. 16, showing the kneading blade.

FIG. 16 is a plan view of the bread casing 307. FIG. 19 shows an XY section of the kneading blade 311 depicted in FIG. 16. As shown in FIG. 16, the shaft 312 of the kneading blade 311 is provided at the center of the bottom of the bread casing 307. Although the drawing shows the case where the bread casing 307 has a horizontal section formed like a rectangle, the invention is applicable to the case where the bread casing 307 has a horizontal section formed like a regular square or circle. Two ribs 333 and 334 (refer to FIG. 17 which shows a vertical section) respectively extending inward from the sides of the bread casing 307 opposite to each other are arranged at the shortest distance from the shaft 312. As shown in FIG. 19, the kneading blade 311 has a section formed like an equilateral triangle having two equal sides representing the length of two kneading surfaces 311*a* and 311*b*. The kneading blade 311 alternately rotates in the forward and reverse direction at substantially equal time rates of rotation.

In the following, the operation of the aforementioned embodiment is described.

Figure 20:
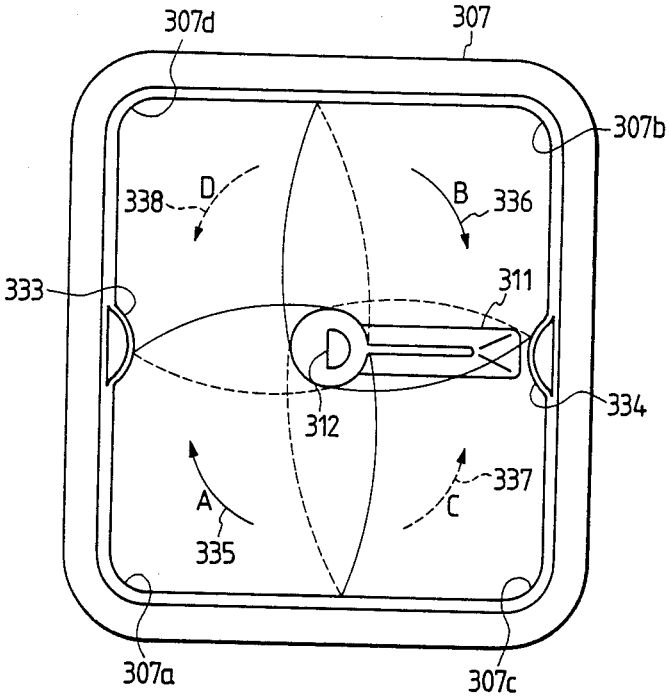
FIG. 20 is a view which explains the automatic kneading process.

When the kneading blade 311 is rotated in the forward direction as represented by the solid-line arrows 335 and 336 of FIG. 20, and in the reverse direction as represented by the broken-line arrows 337 and 338, flour and water are combined with each other to form a large number of nuclei. The nuclei are combined with each other to grow into one large lump of dough. However, when the bread casing has a horizontal section formed like a rectangle or regular square, some flour is left in the corners of the bread casing. When the bread casing has a horizontal section formed like a circle, little flour remains unmixed, but the lump of dough easily turns together with the kneading blade. On the other hand, in the case where the aforementioned ribs are arranged so that the top end of the kneading blade approaches the inner wall of the bread casing with the rotation of the kneading blade. Further, the lump of dough stops in the rotation of the kneading blade, the lump of dough stops in the front of the respective rib and moves vertically. Accordingly, when the symmetric sectional form and the forward-reverse rotation sequence of the kneading blade 311 are selected and the ribs 333 and 334 are provided, bread ingredients 310 are kneaded as follows.

In the forward rotation case, represented by the arrows 335 and 336, the lump of dough meets with resistance from the ribs 333 and 334, so that the lump of dough is kneaded vertically in the areas A and B (surrounded by the solid line), respectively, containing the corners 307*a* and 307*b* of the bread casing 307 while it stays with respect to the direction of rotation of the kneading blade 311. It is now assumed that the lump of dough is kneaded vertically in the area A (surrounded by the solid line) containing the corner 307*a*. Water from the lump of dough is deposited on the inner wall of the bread casing 307 and the surface of the rib 333 which touches the lump of dough in the area A. When the quantity of water thus deposited increases to some degree, the resistance (viscosity) of the contact portion decreases so that the lump of dough climbs over the rib 333. However, the lump of dough meets with resistance of the rib 334 soon. Accordingly, the lump of dough stays in the area B (surrounded by the solid line) containing the corner 307*b* and is kneaded vertically. While the lump of dough stays in the area B, water is vaporized from the inner wall of the bread casing 307 and the surface of the rib 333 in the area A. As this occurs, the resistance (viscosity) of the contact portion is recovered so that the lump of dough can be kneaded in the area A when it turns apart from the area B.

When the kneading blade 311 is rotated in the reverse direction, as represented by the arrows 337 and 338, the lump of dough is kneaded in the areas C and D (surrounded by the broken line) respectively containing the corners 307c and 307d in the same manner as in the case of forward rotation, thus obtaining good dough.

Due to the configuration of this emboidment, the lump of dough is kneaded uniformly in the respective areas A, B, C and D and, accordingly, the flour is completely mixed without deposition on the inner wall of the bread casing 307. Consequently, a good automatic kneading process can be carried out.

As described above, according to this embodiment, a shaft for rotation of the kneading blade is provided at the center of the bottom surface of the bread casing having a horizontal section in the form of any one of a square, a rectangle and a circle; two ribs extending inward from the side wall of the bread casing opposite to each other are provided in a plane perpendicular to the bottom surface of the bread casing and containing the center of the shaft; the two ribs are arranged at the shortest distance from the shaft; and the kneading blade having a section perpendicular to the rotation radius in the form of an equilateral triangle having two equal sides representing the length of two kneading surfaces, alternately rotates in the forward and reverse direction at substantially equal rates of time of rotation, and is connected to a driving portion for repeating the procedure of forward rotation, stop, reverse rotation and stop in that order. Accordingly, dough can be kneaded uniformly along the entire surface of the inner wall of the bread casing, preventing flour from remaining unmixed in the upper ends of the ribs and the corners of the bread casing. Accordingly, the apparatus according to this embodiment can be used as a monofunctional dough kneading apparatus, or can be incorporated into a microwave heating apparatus (oven range) or electric/gas oven for the purpose of baking bread.

What is claimed is:

1. A microwave oven assembly for preparing a plurality of different foods selectively, comprising:

a heating chamber, including a bottom surface having a substantially central opening, for enclosing the foods during preparation;

a microwave oscillator for generating a first type of energy within the chamber;

a heating element for generating a second type of energy effective to heat the chamber;

a first rotatably mounted hollow shaft aligned with the central opening perpendicular to the plane of the bottom surface;

a second rotatably mounted shaft concentrically disposed within the first shaft and extending into the chamber, said second shaft being dielectric and rotatable independent of the first shaft;

a first motor coupled to the first shaft exterior to the chamber for rotating the first shaft without rotating the second shaft; and a second motor coupled to the second shaft exterior to the chamber for rotating the second shaft without rotating the first shaft;

said first shaft including means for removably mounting a first food preparing element rotatable with the first shaft; said second shaft including means for removably mounting a second food preparing element rotatable with the second shaft.

2. The microwave oven of claim 1, wherein a choke cavity is provided proximate the opening encompassing the first shaft, for preventing said first energy from leaking out of the chamber.

3. The microwave oven of claim 2, wherenin said choke cavity comprises a shaft bearing for supporting said first shaft, side wall, and a bottom wall for deflecting the energy back into the chamber.

4. The microwave oven of claim 1, wherein said first food preparing element comprises a kneading blade rotatably mounted on a third shaft which is removably connected to said first shaft.

5. The microwave oven of claim 4, wherein said kneading blade is provided with a section perpendicular to a rotation radius of said blade, in the form of an equilateral triangle having two equal sides representing a length of two kneading surfaces, said blade disposed to be alternately rotated in the forward and reverse directions at substantially equal time rates of rotation by the first motor.

6. The microwave oven at claim 1, wherein said second food preparing element comprises a removable turntable rotatably mounted on a rotary bed.

7. The microwave oven of claim 1, further comprising:

a bread pan, including a bottom surface and interior side walls, configured substantially rectangular, including a substantially central opening for penetration by the kneading blade, vertically extending ribs on opposing interior side walls, and a support portion fixedly secured to said bottom surface of said bread pan and having a leg;

hook-like member fixed to the bottom surface of said chamber and disposed to engage said leg when said bread pan is turned in a forward rotating direction of said kneading blade; and a reverse blocking member fixed to said support portion, said reverse blocking member disposed to restrict movement of said support portion when said kneading blade is rotated in a reverse to rotating direction.

8. The microwave oven of claim 1, further comprising:

a rotary connector shaft linked to said second shaft and fixed to a rotary bed for rotatably supporting said removable turntable;

a disc shaped conductive plate attached to said rotary connector shaft, disposed to prevent said first energy entering a gap between said rotary bed and the bottom surface of the chamber.

* * * * *